US012752169B1

(12) United States Patent
Trombetta

(10) Patent No.: US 12,752,169 B1
(45) Date of Patent: Oct. 6, 2026

(54) SWIM STAGE TRAINER

(71) Applicant: Todd Trombetta, Hallandale Beach, FL (US)

(72) Inventor: Todd Trombetta, Hallandale Beach, FL (US)

( * ) Notice: Subject to any disclaimer, the term of this patent is extended or adjusted under 35 U.S.C. 154(b) by 196 days.

(21) Appl. No.: 18/518,396

(22) Filed: Nov. 22, 2023

(51) Int. Cl.
*A63B 69/12* (2006.01)
*B63C 9/093* (2006.01)

(52) U.S. Cl.
CPC ..... *A63B 69/12* (2013.01); *B63C 9/093* (2013.01); *A63B 2225/605* (2013.01)

(58) Field of Classification Search
CPC ... A63B 2225/605; A63B 69/12; A63B 69/14; B63C 9/08; B63C 9/087; B63C 9/093
See application file for complete search history.

(56) References Cited

U.S. PATENT DOCUMENTS

| | | | | |
|---|---|---|---|---|
| 5,184,968 | A | 2/1993 | Michalochick | |
| 5,413,485 | A * | 5/1995 | Adee | A63B 69/12 434/254 |
| 6,260,199 | B1 | 7/2001 | Grunstein | |
| 2014/0134902 | A1 * | 5/2014 | Gadler | B63C 9/115 441/79 |
| 2014/0302970 | A1 * | 10/2014 | Sinclair | A63B 21/065 482/105 |

* cited by examiner

*Primary Examiner* — Kang Hu
*Assistant Examiner* — Correll T French
(74) *Attorney, Agent, or Firm* — Christopher J Van Dam, PA; Chris Vandam

(57) ABSTRACT

A swim training device in method wherein a suit is provided with a plurality of down facing pockets. Each of the pockets is adapted to hold a removable flotation pad. The pockets are oriented on the body of the device symmetrically to improve balanced flotation. The upper pockets on the shoulders and lower pockets on the hips are on a lateral edge of the device to avoid hindrance of movement. The swim training process is facilitated by progressively removing flotation pads from the pockets in a specified order to improve confidence and maintain symmetry and balance while completing a training regimen.

11 Claims, 5 Drawing Sheets

SWIM STAGE TRAINER

B. CROSS-REFERENCES TO RELATED APPLICATIONS

None.

C. STATEMENT REGARDING FEDERAL SPONSORED RESEARCH OR DEVELOPMENT

None.

D. NAMES OF PARTIES TO A JOINT RESEARCH AGREEMENT

None.

E. REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

F. STATEMENT REGARDING PRIOR DISCLOSURES BY AN INVENTOR OR JOINT INVENTOR

None.

G. BACKGROUND OF THE INVENTION

1. Field of the Invention

The present invention relates to teaching people how to swim. More particularly, the invention embodies a device and method of use to progressively teach various methods of swimming.

2. Description of Related Art Including Information Disclosed Under 37 CFR 1.97 and 37 CFR 1.98

The prior art has failed to solve at least the following issues: providing a worn flotation device with strategically located multiple pockets adapted to hold removable flotation pads combined with a method to systematically reduce the flotation force as a student learning to swim progresses; and, it can be practiced with most other types of conventional swimming lessons; and, it completely eliminates dunking and submersion as used in most other training methods; and, the flotation inserts are placed to accommodate an improved range of movement and comfort; and, the strategically located pockets with flotation pads are configured for different swim styles, strokes and ability of swim student; and, the flotation pockets may be positioned inside the suit, thereby preventing inadvertent or unauthorized removal of the flotation pads; and, the number and location of flotation pockets with flotation pads allows a highly mobile and sleek device; and the plurality of pockets and inserts (generally about twelve and could be anywhere between about eight to eighteen) are placed symmetrically to maintain balanced buoyancy throughout the training method.

Prior art swimming teaching methods and training devices have used a variety of flotation devices in the past. For example, floating belts, life-jackets, kick boards and inflatable armbands have been used by swimming instructors in the pool. Many of these training devices and methods require explicitly or incidentally that the student be submerged under the water. For many students this is a distressing experience and it tends to slow or retard any progress in learning to swim and reduces confidence being in the water.

The prior art has failed to disclose or suggest the combination of features found in the presently claimed method and process. For example, U.S. Pat. No. 6,260,199 was issued to Grunstein discloses a buoyant swimwear but fails to appreciate the benefits of specific placement and sequential removal of flotation pads from the swimsuit structure. The "costume" in Gunstein only has three pads and resembles a padded wetsuit. It discloses one large pad in front and two in the back along with a padded neck panel to keep the child's head above water. Gunstein suggests that the padding can be sewn into the suit or attached to the exterior of the suit in the form of strings of buoyant beads, buoyant waist-coats, or floatation pads or blocks. The configuration of the pads eliminates the prospect of removing any one of the three pads, as it would create an imbalance for the swimmer. Gunstein describes the object of the invention as to provide the wearer positive buoyancy, and some degree of protection from solar radiation. There is no mention or claim of a systematic progressive removal of buoyancy or a method of teaching a child how to swim.

Inventor Huertas Gomez in disclosure WO2014177731A1 also fails to solve the problem in an efficient way by adjusting the thickness of the flotation elements instead of the plurality of strategically located inverted pockets on the present configuration. This can cause the student to imbalance and may also risk holding the student floating in a face down position if exhausted. Gomez also has three large padded areas, with almost identical placement to Grunstein: one large pad on the front and two on the back. Gomez' configuration of the pads eliminates the prospect of removing any one of these three pads because it would create an imbalance for the swimmer. Gomez also adds two small pads on the exterior waist, but nothing to balance that particular buoyancy on the front which could put the wearer face down in the water. Gomez claims that the item allows the wearer to freely move their legs. However, Gomez places two pads on each of the front and rear of the legs. By contrast, the present disclosure was developed through numerous prototypes and vigorous testing to determine that the best place for lower buoyancy is on the outer part of the leg. Testing and experimentation proved that in fact buoyancy placed on the front and back of the wearer's leg actually created tremendous resistance and inhibited the wearer from properly moving their legs in a manner necessary to learn to maintain buoyancy and ultimately learn to swim. The strategic positioning of the lower flotation devices on the outside of the legs in their current disclosure proved to be critical in the overall functionality of the device and the method.

U.S. Pat. No. 6,871,357 issued to Herman also discloses a flotation swim garment for children that fails to solve the swimming training issues. This common device is essentially a life jacket that fails to allow for the adjustment of flotation force and does not appreciate the balance needed by a learning swimmer. Herman characterized its device as a flotation swim garment with interior flotation devices covered by the garment that are inseparable from the garment. The distribution of the flotation panels with more in the front than the back does promote the child leaning more towards the back instead of floating face down. In contrast, the present disclosure features a removable pad method which calls for the rear pad removal before frontal pad removal to keep more buoyancy on the front. However Herman is nothing more than a simple flotation device expressly described as a, "floating swim garment." Herman does nothing to teach a child to swim, which is the only way to really prevent drowning. A key feature of the present device and associated method is driven by its proven process to teach a child to swim, its affordability compared to formal swim instruction and the flexibility for a parent or caregiver to achieve the same results as a professional by following the step by step instructions.

British patent GB 2459709A attempts to solve the imbalance and adjustable flotation issues by having inflatable bladders connected by air tubing. This device requires a pump and is subject to leaks and is highly imbalanced and therefore does not solve the question of how to train a student how to swim.

British patent GB 2,478,766 to Taylor provides for a swim training device to strengthen swimmers. Taylor's design lacks the symmetry needed to teach new swimmers and fails to appreciate the swimming method used with any floating swim device to teach children how to swim. Similarly, British patent GB 2,507,550 provides for buoyant swimming shorts and lacks a contemporaneous method to teach swimming.

Other patents describing the closest subject matter provide for a number of more or less complicated features that fail to solve the problem in an efficient and economical way. None of these patents suggest the novel features of the present invention.

The present device and method of training solves these problems by strategically placing the flotation pockets in a balanced, symmetrical manner combined with the teaching process of strategic and systematic removal of particular flotation pads to adjust the head to foot balance of the swimmer as the swimmer gains more confidence propelling with a combination of arm and leg movement. The present device and method removes float panel inserts in a specific order to progress through predetermined swimming exercises.

The present device, with the panels on the outside, is perfect for training as the flotation devices are easily removed and replaced by the instructor during lessons or during practice with the parent or caregiver. The present device and method avoids the need to undress the student or reach inside the device when panels are removed or reinserted.

In one version of the device, the pockets are located on the interior surface of the device and therefore cannot be removed by the student while wearing the device. This can increase the safety, particularly as students tend to remove and adjust clothing when not immediately in the water. However, being next to the water before and after swimming still exposes the students to risk when they may not be watched as closely as during active swim instruction.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

H. BRIEF SUMMARY OF THE INVENTION

It is an object of the present invention to provide a device to safely and quickly teach a student to swim by progressively reducing flotation, therefore necessitating a gradual increase in effort by the student while performing the necessary swimming motions and thereby increasing the confidence and capability of the student.

It is another object of this invention to provide a swim training device that is comfortable for the student to where when not actively in the water but still having some risk near the water before or after swimming. This is not true of other flotation devices in the prior art.

It is still another object of the present invention to provide a device and associated training method for swimming that is readily adaptable to different skill levels and swimming conditions.

It is another object of this invention to provide an affordable swim training device that can be successfully utilized by a parent, grandparent, older sibling or friend in the absence or presence of an experienced swim instructor. The parent or caregiver need no formal training nor do they need to possess the ability to swim themselves. They can achieve a successful result by following the simple instructions supporting the novel and unique method developed in unison with the invention.

It is yet another object of this invention to provide such a device that is inexpensive to manufacture and maintain while retaining its effectiveness and marketability.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

I. BRIEF DESCRIPTION OF THE SEVERAL VIEWS OF THE DRAWINGS

With the above and other related objects in view, the invention exists in the details of construction and combination of parts as will be more fully understood from the following description, when read in conjunction with the accompanying drawings in which.

J. DETAILED DESCRIPTION OF THE INVENTION

Figure 1:
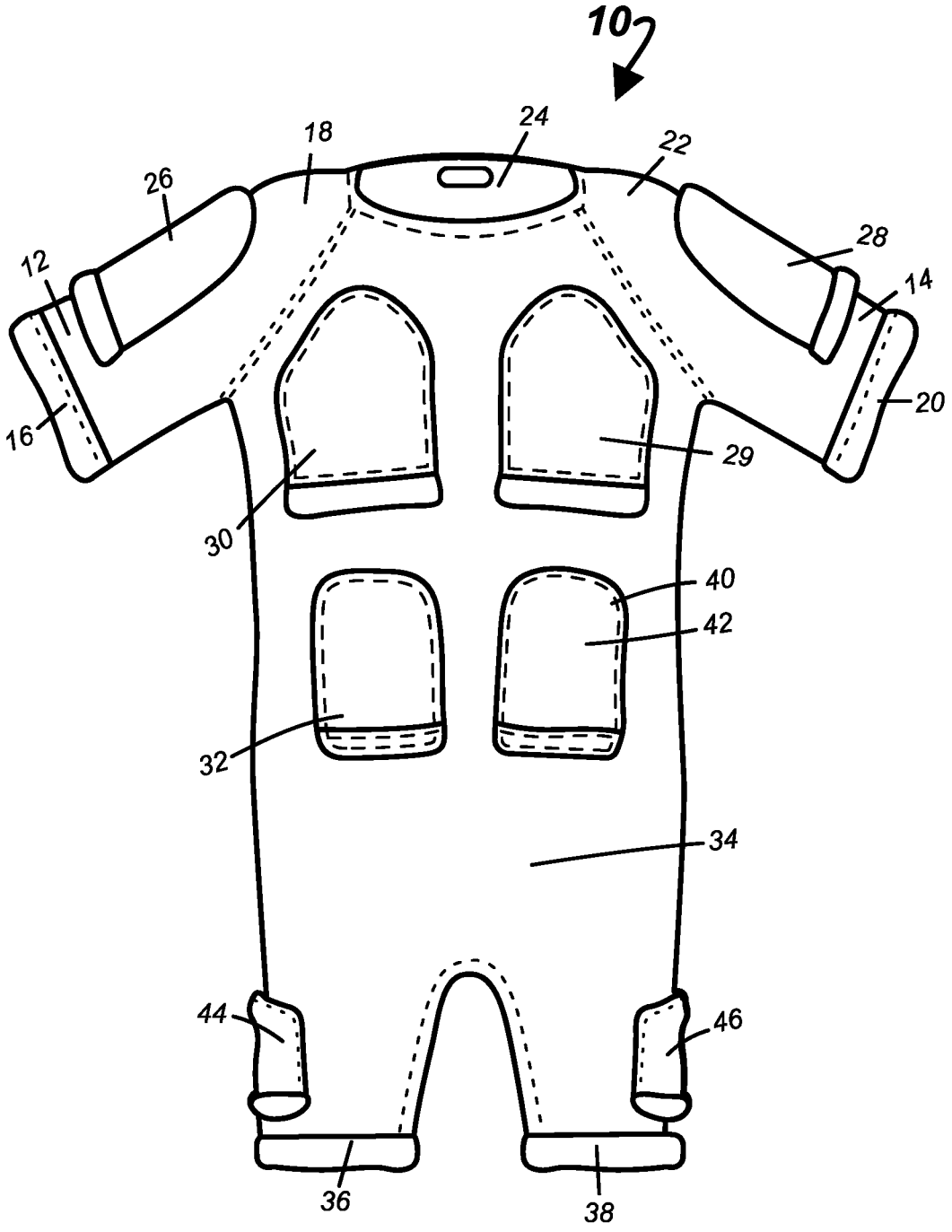
FIG. 1 shows an elevation view of a front side of a swimming training device.
Figure 2:
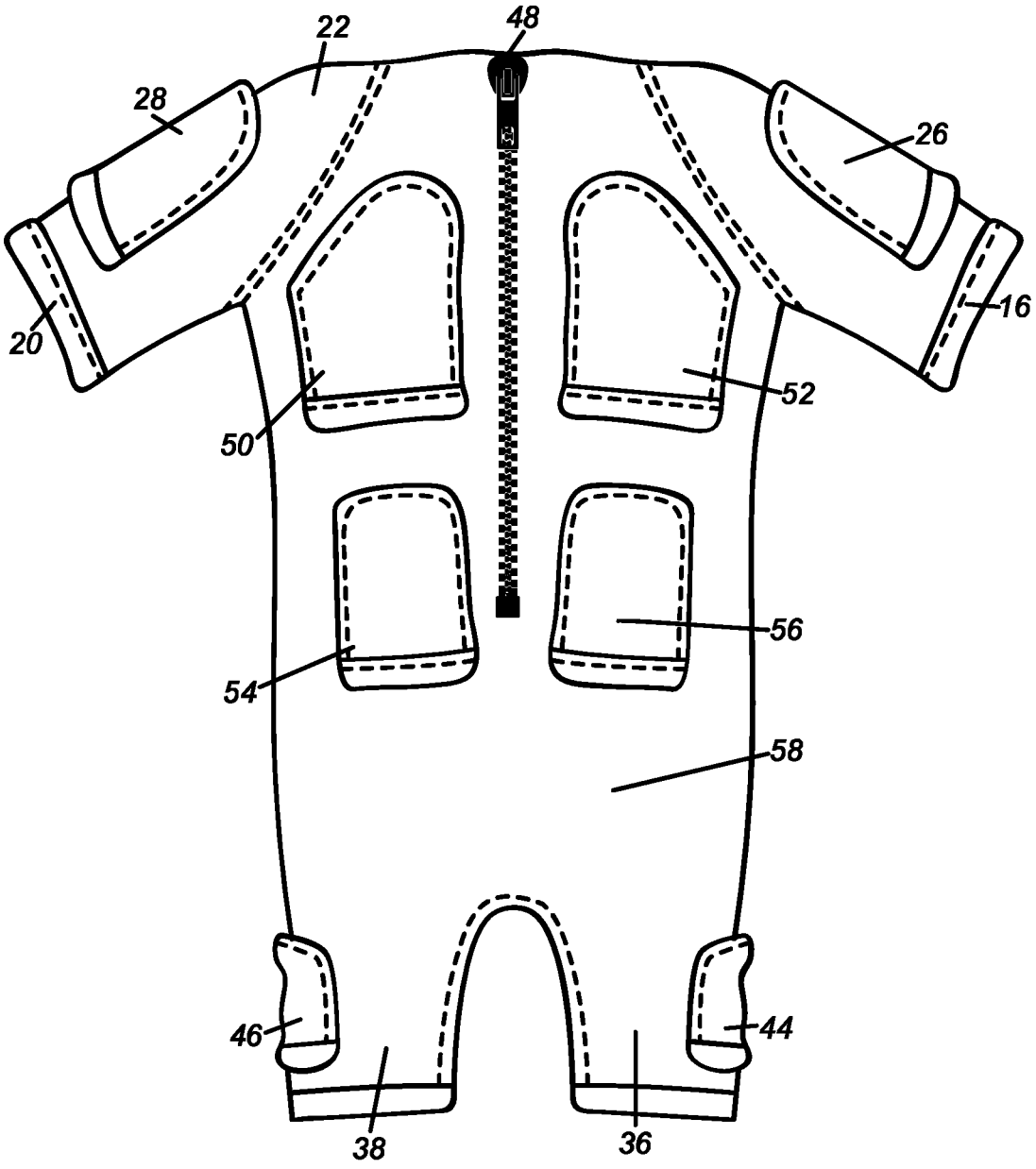
FIG. 2 shows an elevation view of a rear side of the swimming training device.
Figure 3:
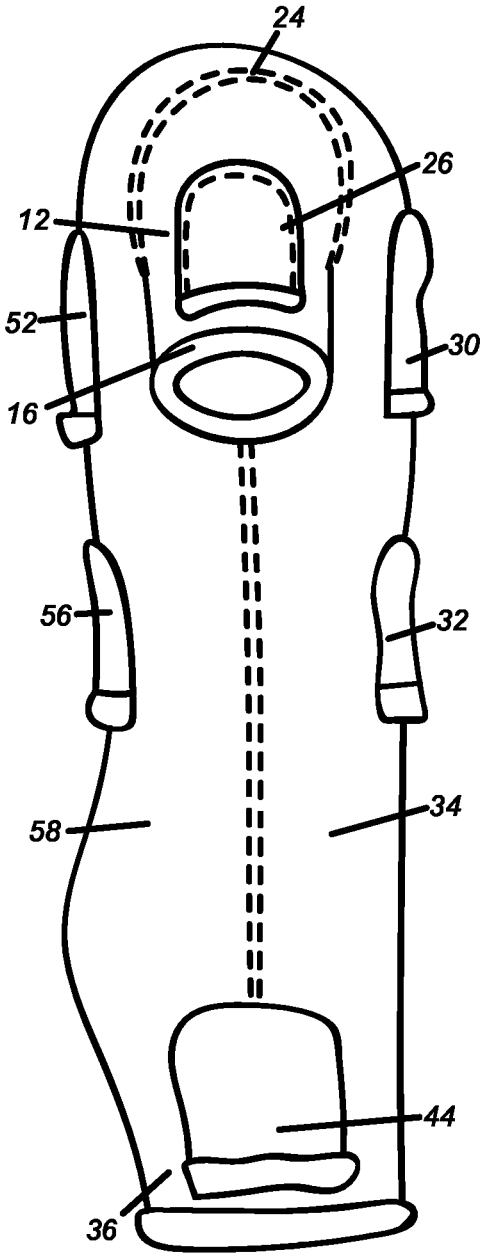
FIG. 3 shows an elevation view of a right side of the swimming training device.
Figure 4:
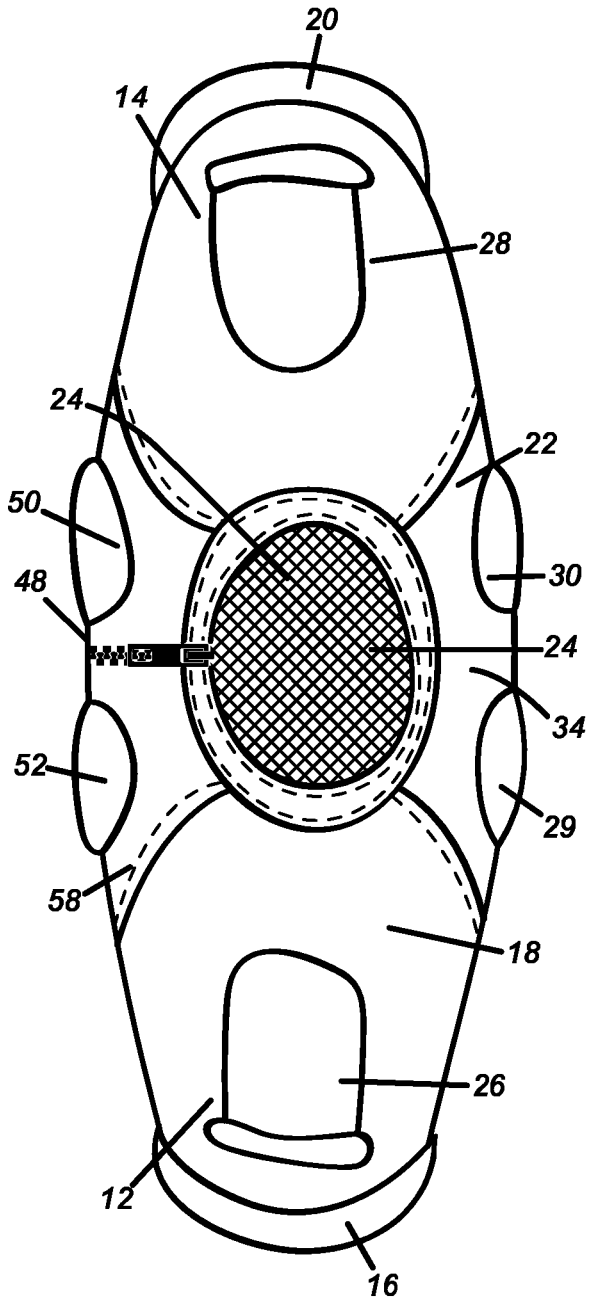
FIG. 4 shows a top plan view of the swimming training device.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the swim training device or method, the training device, the swim teaching device, the training suit, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

The swim training method and training suit is the most gentile and effective way to teach a child to initially float, tread water and then swim safely in the water without the need for a professional swim instructor. The swim stage training method and training suit can also be used by a professional swim instructor to accelerate the learning process.

During each stage of the training process, the instructor is with the child and following a sequence of specific tasks. The process is intentionally slow and steady to reduce the stress on the child. If the child struggles during any stage of the process the instructor can repeat that particular step in the process or go back to an earlier stage.

Initially, the student is wearing the training device with all of the flotation pads inserted into the device. The student kicks their feet and moves their arms in an effort to keep the can above the surface of the water. The student is then encouraged, but not forced, to place their face into the water and blow bubbles. The student is then encouraged to place their face under the water holding the breath.

The student is then told to try to propel themselves forward by moving their arms and kicking their feet. It is helpful to encourage the student to try to move from one area of the pool to another. For example, starting at the water's edge and trying to make movements toward the latter, steps, a float or another person. It has been a highly effective to use a parent or other trusted guardian to be in the pool with the student and be a goal toward which the student can try to swim. Encouragement and confidence are important to quickly and safely learning how to swim.

The student is then taught to safely float lying on their back with arms spread wide and legs also partially spread to stabilize the position. The student is instructed to relax, breathe and float. This provides the swimming student a safe place to calm down and rest at any point they feel the need and increases confidence in their new abilities.

The swim training device and method includes a wearable training suit and detailed instructions on how to teach someone to swim. The suit includes a plurality of buoyancy assistance inserts which are removed in a specific order to facilitate the learning method. In one embodiment there are twelve pockets with associated inserts strategically positioned around the suit.

It has been found useful to have the flotation inserts around the front and rear of the torso to be of the same size. Then, the inserts and pockets around the shoulders and hips may be slightly smaller to accommodate their placement and allows the student to enjoy maximum freedom of movement. The smaller shoulders and hips flotation devices may be thicker to supply equal buoyancy to the front and rear torso flotation inserts.

The inserts are positioned to allow the child to float perfectly balanced in the water. The location of the pockets enhance this balance and also allow for maximum freedom of movement while wearing the suit both in the water during training and water adjacent before and after training. In this way, the student does not need to remove the suit when not actively in the water. This increases the safety from risks associated with inadvertent falls into the water.

As a result of the unique aspects of the present invention, the maximum range of motion is achieved by float pocket position. For example, the strategic placement of the leg pockets and floats on the outside hip, instead of the front or back of the leg, avoids resistance while the child is kicking and stroking in the water. The material from which the suit is constructed is sufficiently flexible to allow for a wide range of motion while swimming and also remains comfortable while out of the water. This allows the student to train with the same natural range of motion while wearing the suit as they will later swim without the suit assisting their buoyancy.

Advantages of the present configuration and process over the prior art also include that the student can float naturally in an upright position with her head above water while not swimming, resting or in a panic mode. In the early stages of training having the students face out of the water increases their confidence and allows them to focus on propelling themselves forward with arm and leg motion without the risk of having their face under water.

As the student gains confidence in their ability and is able to propel themselves through the water, flotation devices in pockets are removed in opposite left and right pairs to maintain balance. The nature of the pockets allow the instructor to quickly, and sometimes without the student even noticing, remove the buoyant pads.

By removing only a pair of buoyant pads at a time, the overall buoyancy of the device is slowly and gradually reduced as the student is able to support themselves by stronger swimming. The systematic reduction of buoyancy is often so gradual that the student does not notice the reduction and naturally compensates their swimming style, speed and strength to achieve performance similar to if they were not wearing any buoyant suit at all.

Referring now to the drawings, where the present invention is generally referred to with numeral 10, it can be observed that it basically includes a sleeve 12, a sleeve 14, a cuff 16, a shoulder 18, a cuff 20, a shoulder 22, a neck 24, a shoulder pocket 26, a shoulder pocket 28, a chest pocket 29, a chest pocket 30, an abdomen pocket 32, a front panel 34, a leg 36, a leg 38, a seam 40, and abdomen pocket 42, a hip pocket 44, a hip pocket 46, a zipper 48, a shoulder pocket 50, a shoulder pocket 52, a pocket 54, a pocket 56 and a rear panel 58.

Looking at the drawings, FIGS. 1 through 4, show an exemplary embodiment of the swim trainer device. Generally, a front panel 34 is provided covering a front side of the student that is opposite a rear panel 58 covering the back of the student, together forming the structure of the device. The front panel 34 includes a chest pocket 29 and chest pocket 30 in an upper region. An abdomen pocket 32 and an abdomen pocket 42 are also provided and are each adapted to hold a flotation pad.

The swim trainer device is dimensioned to fit a preselected size of student. They may be provided in smaller sizes for younger children and larger sizes for adults. Each will have the plurality of pockets situated in a similar configuration and proportionate to the size of the device. A particularly effective version will have short sleeves 12 and 14 and short legs 36 and 38. However, longer sleeves and/or longer legs may also be effective, particularly in cooler water environments. Longer sleeves and legs may also be provided to improve the sun protection of the device when used outside.

An aperture for the neck 24 is provided between shoulder 18 and shoulder 22. Shoulder pocket 26 is provided on the right sleeves 12 while shoulder pocket 28 is provided on the left sleeve 14. A cuff 16 may be provided at the termination of sleeve 12 similar to the cuff 20 at the termination of sleeve 14. The cuffs 16 and 20 reinforce the respective sleeve 12 and 14. Optionally, a cuff may terminate the lower end of the leg 36 and legs 38.

A shoulder pocket 26 is centered on the upper part of the sleeve 12. Balancing out the other side is a shoulder pocket 28 on sleeve 14. On the lower side of the device is hip pocket 44 on a lateral side of the leg 36 and hip pocket 46 on a lateral side of leg 38. Preferably, the hip pocket 44 and hip pocket 46 are on the side of the device spanning the seam between the front panel 34 and rear panel 58. This avoids having the flotation device on the front or back of the legs and therefore provides a greater flexibility of movement.

Looking at FIG. 1, abdomen pocket 42 is shown to include a seam 40 around the periphery of the upper and side of the abdomen pocket 42. The seam of 40 does not close the bottom edge of the abdomen pocket 42. By having an open bottom of the abdomen pocket 42 the flotation pad it can be inserted from the bottom of the abdomen pocket 42 and be held in place by the seam 40 sewn into the front panel 34. Each pocket is similarly constructed.

Each of the several flotation pockets, including the shoulder pockets 26 and 28, the hip pockets 44 and 46, the chest pockets 29 and 30, the abdomen pockets 32 and 42, the shoulder pockets 50 and 52 and the pockets 54 and 56 are each similarly constructed with an open lower edge into which the flotation pad may be inserted in removed and bounded on the sides and top with a seam affixing it to the suit to hold the flotation panel securely during use.

Essentially, each of these pockets is upside down from the configuration of pockets in most other textile devices. This allows the flotation pad to rise into the upper side of the pocket during use and avoids the flotation pad from tending to float out of and escape from the respective pocket.

Optionally, the lower, open side of each of the pockets may include a closure means, such as hook and loop fasteners, zippers, magnets or other closure means. However, use has shown that the pockets will readily retain a complementary sized flotation pad without any lower closure feature.

Figure 5:
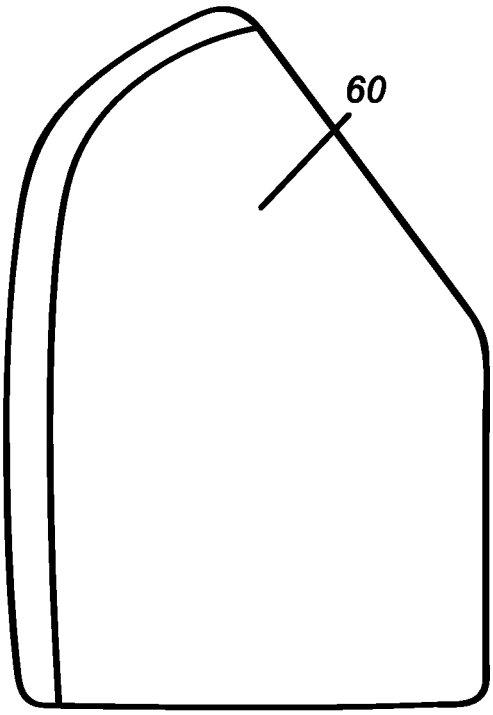
FIG. 5 shows a perspective view of a flotation insert.
Figure 6:
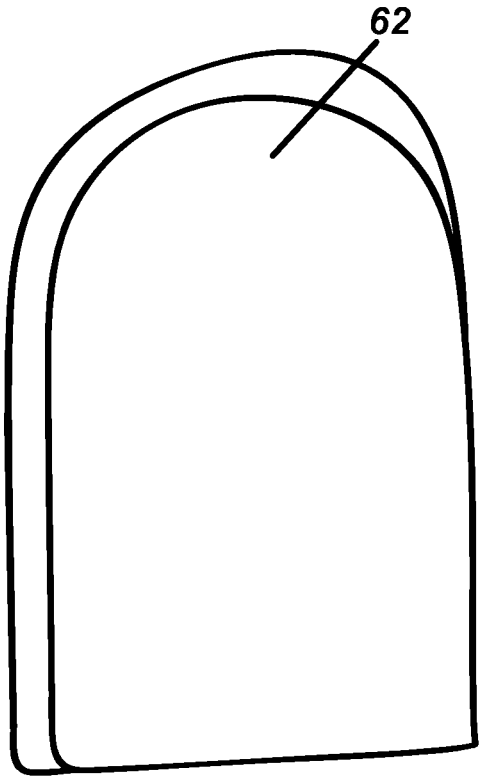
FIG. 6 shows a perspective view of a flotation insert.

FIGS. 5 and 6 show examples of flotation inserts. Inserts 60 and 62 are dimensioned to fit a specific pocket. For example, the asymmetrical shoulder pockets 50 and 52 are best suited with inserts shaped similar to inserts 60 shown in FIG. 5. Similarly, the symmetrical insert 62, shown in FIG. 6, is proportioned to fit snugly into similarly shaped pockets such as the shoulder pockets 26 and 28, they hit pockets 44 and 46, the abdomen pockets 32 and 42 and the rear pockets 54 and 56.

The lateral side shoulder pockets 26 and 28 and hip pockets 46 and 44 may be dimensioned somewhat smaller, although have a similar shape. These pockets may be well-suited to have a slightly thicker insert to maintain a sufficient amount of buoyancy while in use.

Generally, each of the floats will be constructed of a low-density and buoyant material. The pads should not absorb water, but should maintain their buoyancy consistently. Closed cell polymer foams have been shown to be effective. Other polymer faced or skinned foams may also be sufficiently waterproof to maintain consistent buoyancy and therefore be effective.

In one version of the flotation device, each of the respective pockets are positioned on a similar part of the body but are sewn with the opening inside the front panel 34 and rear panel 58 to be against the students body. This will further reduce the likelihood or possibility that a flotation pad could be purposefully or inadvertently removed. This can enhance the safety, particularly for younger students.

The buoyant inserts 60 and 62 are preferably flexible and able to conform to the contours of the student's body underneath the device. The inserts 60 and 62 may also be bent or partially folded to insert them into any of their pockets. As the inserts 60 or 62 is placed into the pocket fully, it is released and springs tight against the inside of the respective pocket. In this way, the inserts 60 and 62 are better fictionally fit inside the corresponding pocket.

An important aspect of the present invention is that a particular training method is provided to use with the device to achieve rapid and safe swim training. To begin, the student puts on the device and each of the pockets has a buoyant inserts snugly fit. This is the condition of maximum buoyancy with each pocket filled with a buoyant insert.

The student then enters the water with the instructor to float with their head above the water. The student gains confidence by being able to feel there is very low risk of submerging in the water. This allows a student who is unfamiliar with being in the water to feel comfortable without holding onto any structure or person to maintain their stability in the water.

Next the buoyant inserts from shoulder pocket 26 and 28 are removed and swimming exercises are conducted. In a related alternate step, it may be possible to remove only one of the buoyant inserts from either the shoulder pocket 26 or 28 from the dominant side of the student. For example, if a student tends to swim harder with their right arm than their left arm it may be possible to remove only the buoyant insert from shoulder pocket 26 on the right side and leaving the pad inserted on the left side shoulder pocket 28.

As the swimming exercises continue, the next step is to remove the flotation pads from the lower back pockets 54 and 56 to reduce the overall buoyancy yet maintain a balanced and controllable body orientation while floating in the water. Generally, in this step the chest pockets 29 and 30 and abdomen pockets 32 and 42 remain filled with the buoyant pads.

Again, as the swimming exercises continue, the abdomen pockets 32 and 42 are the next to have the flotation pads removed. By following this precise order the balance of the student is maintained and confidence in their ability to swim is steadily improving.

It should be appreciated that the steps of removing pads from pockets sequentially may not all occur in a single swimming session. Instead, the sets of pockets may be cleared from the buoyant pads over several swim training sessions days or weeks.

In the next progressive step of removing buoyant pads, the shoulder pockets 50 and 52 are removed. This further reduces the overall buoyancy of the device and is rapidly approaching the point where the student is able to swim with minimal or no buoyancy assistance.

In the final step, as the student is able to more confidently maneuver in the water using arms and legs, all of the remaining pads are removed. The suit itself, may provide some buoyancy, even without any of the flotation pads inserted into any of the pockets. The front panel 34 and rear panel 58, as well as the sleeves 12 and 14 may be fabricated from a material such as neoprene or other closed cell polymer material similar to that used in wetsuits. Other suitable materials may be stretchable spandex or lycra-type materials. Each of the pockets may also be fabricated from similar materials and also may affect the buoyancy of the overall device, even when none of the buoyant pads are inserted into the pockets.

The device may be completely reversible in that it may be worn inside out. When the pockets are on the exterior side of the device, the trainer can readily add or remove point pads from any of the pockets while the student is actively swimming. Conversely, if the device is worn so that the pockets are all on the inside, it provides a safe condition when the student is swimming with less supervision. When the pockets are on the inside, it may be considered a student practice mode. Whereas, with the pockets on the outside, it may be considered to be in an active training mode.

On the front panel 34, the chest pockets 29 and 30 and abdomen pockets 32 and 42 are spaced both horizontally and vertically. This allows a greater flexibility in both a vertical and horizontal axes. Similarly, the shoulder pocket 50 and 52 and pockets 54 and 56 on the rear panel 58 are positioned with both vertical and horizontal spacing to provide a similar flexibility in both horizontal and vertical movements.

An important version of the present invention can be fairly described as a method to teach people how to swim. Swimming is often taught in a body of water, such as a pool, but can be done in lakes, rivers or other bodies of water. The student learning to swim is provided a suit that is dimensioned to fit that particular student. Suits may be made in several sizes to fit most sizes of students from children to adults. On the front of the suit are a pair of upper front pockets and a pair of lower front pockets that are symmetrically positioned about the sagittal and transverse planes. Similarly, on the rear surface of the suit are a pair of upper rear pockets and a pair of lower rear pockets symmetrically positioned about the sagittal and transverse planes. On an upper surface of the suit, adjacent to the shoulders, on both the left and right sleeve are pockets symmetrically affixed about the sagittal plane. On each the left and right lateral sides of the suit on a lower, inferior and, are symmetrically affixed about the sagittal plane eight left and right hip pocket. The left and right hip pockets are on the sides of the suit and not on the front or back surface. Each of the several pockets mentioned above are dimensioned and contain a flotation pad. Each flotation pad is insertable and removable only from the inferior or lower edge of each pocket. This prevents a flotation pad from floating out of the upper side of the pocket. It also allows the flotation pad to be readily removed through the learning to swim process. The student is instructed to perform a first exercise in the water with all the pads in the pockets. The exercise generally requires the student to move their feet and hands to maintain positive buoyancy and to keep their face out of the water to ensure the can breathe. This allows the student to gain much confidence in their ability to take care of and protect themselves with the buoyancy provided by the flotation pads. Next, the instructor or student removes the flotation pads from both the left and right shoulder pockets. This reduces the overall buoyancy of the suit and requires the student to work a little harder when they perform the second exercise in the water. Each of the exercises can be a variety of swimming motions where the student uses their hands and feet in combination to maintain breathing and balance in the water. Next, the flotation pads from the lower rear pockets are removed, further reducing the buoyancy of the suit. Similar to above, swimming exercises with the hands and feet are performed. Next, the flotation pads from both of the lower front pockets are removed and the student is instructed to perform additional swimming exercises in the water. Next, the flotation pads from each of the upper rear pockets are removed, again reducing the buoyancy provided to the student from the suit. Additional exercises are performed in the water with this reduced condition of buoyancy. Next, the flotation pads from both of the upper front pockets and the pair of left and right hip pockets are removed. The student then performs additional exercises in the water, now with none of the flotation pads in the suit providing additional buoyancy. By going through this process, the student is progressively responsible for providing their own balance, orientation and face out of the water condition to maintain breathing. Optionally, the suit is provided where the pockets are in a similar position, however are on the interior surface of the suit. This may prevent the flotation pads from being intentionally or inadvertently removed during the swimming process or before and after being in the water. Conversely, the pockets may be equally effective when located on the exterior surface of the suit.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A method to teach swimming in a body of water comprising:

providing a suit dimensioned to fit and worn by a swim student;

wherein on a front surface of the suit are symmetrically affixed about a sagittal and transverse plane are a pair of upper front pockets and a pair of lower front pockets;

wherein on a rear surface of the suit are symmetrically affixed about the sagittal and transverse planes are a pair of upper rear pockets and a pair of lower rear pockets;

wherein on a superior surface of the suit on each a left sleeve and a right sleeve, symmetrically affixed about the sagittal plane, are a respective left shoulder pocket and a right shoulder pocket;

wherein on each a left and right lateral and inferior surface of the suit, symmetrically affixed about the sagittal plane, are a respective left hip pocket and a right hip pocket;

wherein each of the pockets is dimensioned to fit, and does contain, a corresponding flotation pad;

wherein each flotation pad is insertable and removable only from an inferior edge of each pocket, wherein the flotation pads provide positive buoyancy to the swim student while maintaining the swim student in an upright orientation with the student's head above water;

instructing a student to perform a first exercise in the water, wherein the first exercise comprises movements of arms and legs to maintain breathing and balance;

removing from the suit the flotation pads from both the left and right shoulder pockets;

and instructing the student to perform a second exercise in the water;

removing from the suit the flotation pads from each of the pair of lower rear pockets;

and instructing the student to perform a third exercise in the water;

removing from the suit the flotation pads from each of the pair of lower front pockets;

and instructing the student to perform a fourth exercise in the water;

removing from the suit the flotation pads from each of the pair of upper rear pockets;

and instructing the student to perform a fifth exercise in the water;

removing from the suit the flotation pads from each of the pair of upper front pockets and the pair of left and right hip pockets;

and instructing the student to perform a sixth exercise in the water;

wherein the removal sequence is biomechanically predetermined such that the rear pockets at each body level are removed before the corresponding front pockets at the same body level, thereby preventing forward tilting and face-down orientation of the student throughout progressive buoyancy reduction.

2. The method of claim 1 further characterized in that the pockets are all affixed to an interior surface of the suit, thereby preventing removal of flotation pads while the suit is worn by the student.

3. The method of claim 1 further characterized in that the pockets are all affixed to an exterior surface of the suit, thereby allowing an instructor to remove flotation pads while the suit is worn by the student.

4. The method of claim 1 further characterized in that the first exercise is an exercise appropriate for a beginning student, and the sixth exercise is an exercise appropriate for a student near proficiency.

5. The method of claim 1 further characterized in that the flotation pads are formed of closed-cell foam.

6. The method of claim 1 further characterized in that throughout each of the first through sixth exercises, the student's face remains above water.

7. A method to teach swimming in a body of water comprising:

providing a suit dimensioned to fit and worn by a swim student, the suit comprising a plurality of pockets symmetrically affixed about a sagittal plane, including upper front pockets, lower front pockets, upper rear pockets, lower rear pockets, shoulder pockets, and hip pockets, each pocket containing a removable flotation pad insertable and removable only from an inferior edge of the pocket;

wherein the flotation pads provide positive buoyancy to the swim student while maintaining the swim student in an upright orientation with the student's head above water;

progressively removing the flotation pads in a predetermined sequence while the student performs swimming exercises between each removal step, the sequence comprising removing shoulder pads first, then lower rear pads, then lower front pads, then upper rear pads, and then upper front pads and hip pads together.

8. The method of claim 7 further characterized in that the pockets are affixed to an interior surface of the suit.

9. The method of claim 7 further characterized in that the pockets are affixed to an exterior surface of the suit.

10. The method of claim 7 further characterized in that the flotation pads are formed of closed-cell foam.

11. A method for progressively teaching a beginner swim student to swim comprising:

providing a flotation training suit worn by the swim student, the suit comprising a plurality of flotation pockets arranged symmetrically about a sagittal plane of the student's body, the flotation pockets comprising at least upper front, lower front, upper rear, lower rear, shoulder, and hip pocket locations, each pocket holding a removable flotation pad insertable and removable only from an inferior opening of the pocket;

conducting an initial swim training session with flotation pads installed in all pockets, maintaining the student in an upright orientation with the student's head above water;

conducting a series of progressive training stages, each stage comprising removing a bilateral pair of flotation pads from a predetermined pocket location and conducting a swim training session after each removal to develop the student's swimming ability at a reduced buoyancy level;

wherein the predetermined pocket locations are removed in the following sequence:

(i) the shoulder pocket pair as a first stage, before any torso pockets are removed; (ii) the lower rear pocket pair; (iii) the lower front pocket pair; (iv) the upper rear pocket pair; and (v) the upper front pocket pair and the hip pocket pair simultaneously as a final stage; said sequence maintaining the student's upright, face-up orientation with the student's head above water throughout all training stages.

* * * * *